United States Patent [19]

Shields et al.

[11] 4,353,227

[45] Oct. 12, 1982

[54] TENSION INDICATOR FOR ELASTOMERIC YARN

[75] Inventors: Harper Shields, Burlington; Roscoe M. Farrell, Pittsboro, both of N.C.

[73] Assignee: Kayser-Roth Hosiery, Inc., Burlington, N.C.

[21] Appl. No.: 205,765

[22] Filed: Nov. 10, 1980

Related U.S. Application Data

[63] Continuation-in-part of Ser. No. 136,891, Apr. 30, 1980, abandoned.

[51] Int. Cl.[3] ..... D04B 15/46; D04B 35/14

[52] U.S. Cl. ..... 66/146; 66/163

[58] Field of Search ..... 28/187; 66/125 R, 146, 66/161, 163; 112/254, 278; 242/49

[56] References Cited

U.S. PATENT DOCUMENTS

| | | | |
|---|---|---|---|
| 2,618,444 | 11/1952 | Taggart | 66/146 X |
| 2,641,913 | 6/1953 | Alric | 66/146 X |
| 3,290,902 | 12/1966 | Warthen | 66/125 R |
| 3,745,793 | 7/1973 | Heinig et al. | 66/146 |
| 4,075,445 | 2/1978 | Kempf | 28/187 X |

FOREIGN PATENT DOCUMENTS

| | | | |
|---|---|---|---|
| 870434 | 12/1941 | France | 66/146 |
| 1428550 | 1/1966 | France | 66/146 |
| 560722 | 4/1957 | Italy | 66/146 |
| 45-15222 | 5/1970 | Japan | 66/163 |

*Primary Examiner*—W. Carter Reynolds

*Attorney, Agent, or Firm*—Bell, Seltzer, Park & Gibson

[57] ABSTRACT

The knitting machine is provided with a yarn tension indicator for continuously monitoring the tension of an elastomeric yarn being withdrawn from a yarn supply source and fed to the needles of the circular knitting machine and for providing a constant visual indication to the machine operator of the tension in the running yarn. The yarn tension indicator includes a base plate and a pointer lever supported in a substantially horizontal position and for pivotal movement on the base plate. Fixed guides are provided for directing the yarn through a movable yarn guide supported for longitudinal adjustment on the pointer lever to urge the same in an upward direction. Weights are supported for longitudinal adjustment on the pointer lever for urging the pointer lever in a downward direction so that when the tension in the running yarn is proper, the pointer lever maintains a horizontal position which may be easily observed by the knitting machine operator.

7 Claims, 2 Drawing Figures

TENSION INDICATOR FOR ELASTOMERIC YARN

FIELD OF THE INVENTION

This application is a continuation-in-part of our copending application Ser. No. 136,891, filed Apr. 30, 1980, now abandoned and relates generally to a tension indicator and more particularly to a tension indicator for continuously monitoring the tension of an elastomeric yarn being withdrawn from a supply source and fed to a circular hosiery knitting machine.

BACKGROUND OF THE INVENTION

It is necessary that the tension be maintained constant when feeding elastomeric yarns to a circular hosiery knitting machine during the knitting of panty hose and the like and wherein at least portions of the panty hose have elastomeric yarns incorporated therein. In this type of machine, it is the usual practice to pass the elastomeric yarn through a manually adjustable tensioning device positioned in the path of travel of the yarn from the yarn supply to the yarn feed finger and the needles of the knitting machine. With the machine running, the operator checks the tension in the yarn by the use of a portable tensiometer and adjusts the manually controlled tension device until the yarn is running at the proper tension.

In accordance with this conventional practice, the operator periodically checks the tension in the yarn with the portable tensiometer to determine if the elastomeric yarn is still being fed at the proper tension. If changes in the tension have taken place, the operator again adjusts the manual tension device so that the yarn runs at the proper tension. Since the periods between times when the tension is checked may be rather long, the tension in the elastomeric yarn may change and the machine may produce a large quantity of panty hose with the elastomeric yarn incorporated therein at a tension which is either greater or lesser than the desired tension so that the panty hose produced during that period of time are not usable.

The tension indicator disclosed in our above-noted copending application operates to continuously monitor elastomeric yarn as it is being fed to a circular hosiery knitting machine. However, in the tension indicator of our copending application, the pointer lever is supported in a substantially vertical position and is provided with a yarn guide at the lower end with the yarn changing direction two times during a substantially Z-shaped path of travel. When a yarn passes through a yarn guide and the direction of travel is reversed, the tension on the yarn is increased by a greater amount than is the case if only a slight change of direction occurs when the yarn passes through a yarn guide.

SUMMARY OF THE INVENTION

With the foregoing in mind, it is an object of the present invention to provide a yarn tension indicator for use with a manually adjustable yarn tension device for providing the operator with a constant visual indication of the amount of tension being applied to the yarn as the elastomeric yarn is being fed to a knitting machine, and wherein the yarn is guided through the tension indicator in such a manner that only slight changes of direction are made by the yarn so that only a small amount of tension is placed on the yarn by the tension indicator.

In accordance with the present invention, the yarn tension indicator includes a base plate which is supported between the yarn supply source and the knitting machine. A pointer lever is pivotally supported intermediate its opposed ends on the base plate and is normally maintained in a substantially horizontal position. A weight is supported for longitudinal adjustment along the portion of the pointer lever adjacent one free end. A movable yarn guide is fixed on the weight and yarn guides are fixed on the base plate so that the path of travel of the yarn is changed by a very small amount. The tension in the running yarn tends to pivot the pointer lever in an upward direction and the weight tends to move the pointer in the downward direction. A counterweight is supported for longitudinal adjustment adjacent the other end of the pointer lever. Indicia is carried by the base plate and adjacent the one free end of the pointer lever for providing a constant visual indication of the tension in the running yarn.

Signal means is carried by the base plate and is engageable by the pointer lever when the yarn breaks or when the tension in the yarn drops below a predetermined amount. The signal means may be operable to stop the machine when the yarn breaks or an abnormally low tension condition occurs in the yarn. The weight and counterweight supported on the pointer lever are adjustable so that the pointer lever may be maintained in a horizontal position when the desired amount of tension is being applied to the yarn.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
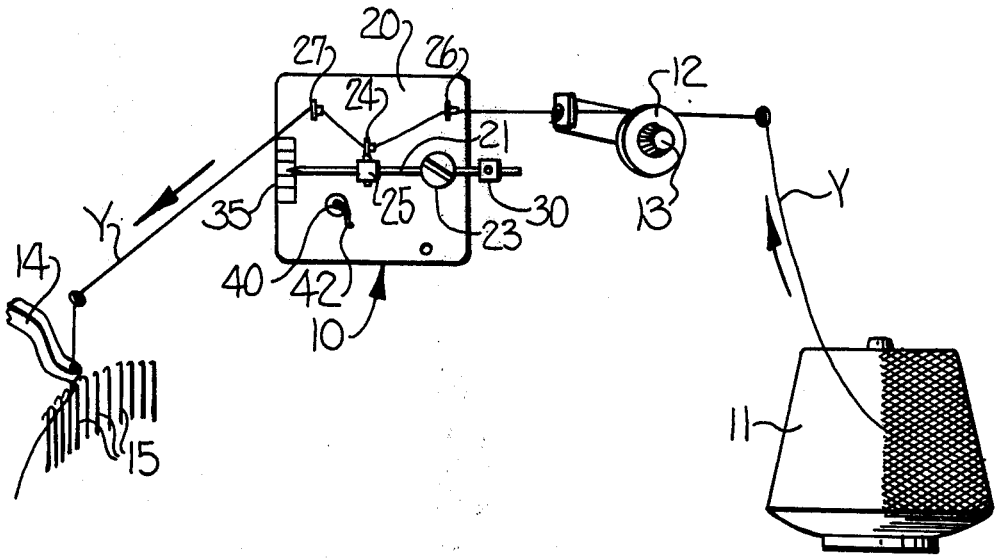
FIG. 1 is a somewhat schematic elevational view showing the position of the tension indicator of the present invention relative to the manual tension device, the yarn supply, the yarn feed finger, and the needles of the knitting machine.

The yarn tension indicator of the present invention, broadly indicated at 10, is illustrated in FIG. 1 as being positioned to provide a constant visual indication of the tension in a running elastomeric yarn Y being withdrawn from a yarn supply source, indicated as a textile supply package 11. The yarn Y passes through a manually adjustable tension device 12, illustrated in the form of a conventional magnetic type brake tension device including a manually adjustable knob 13 for varying the amount of tension applied to the yarn as it passes around the reel thereof. The yarn Y then passes through and is engaged by the present yarn tension indicator 10, in a manner to be presently described, and is fed through a yarn feed finger 14 of a circular knitting machine including a circle of latch needles 15.

Figure 2:
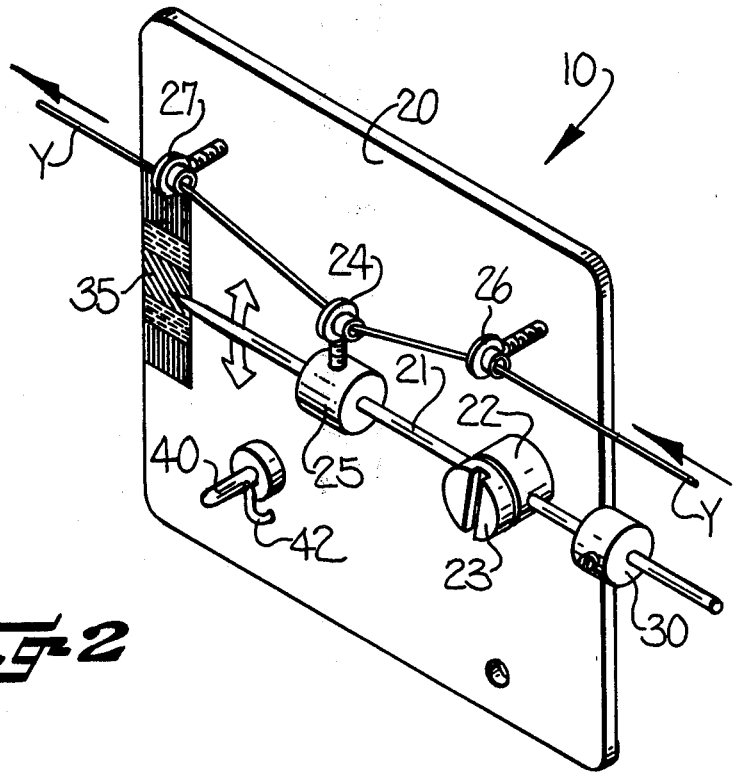
FIG. 2 is an enlarged isometric view of the tension indicator of the present invention.

The yarn tension indicator 10 includes a base plate 20 which is supported in substantially the vertical position shown in FIG. 2 on any convenient location of the knitting machine. A pointer lever 21 is disposed in substantially a horizontal position and includes opposed first and second arms with outer free ends and inner ends fixed on opposite sides of a pivot collar 22. The pivot collar 22 is supported for pivotal movement on a shoulder screw 23, the inner end of which is fixed in the base plate 20. A movable yarn guide eye 24 is carried by the first arm of the pivot lever 21 and, in the present instance, is fixed on a weight, in the form of a collar 25, supported for longitudinal adjustment along the first arm of the pointer lever 21 and the yarn Y is adapted to pass therethrough.

Fixed yarn guide means, in the form of yarn guide eyes 26 and 27, is fixed on the base plate 20 and adjacent opposite sides of the yarn guide 24. The fixed yarn guides 26, 27 are positioned slightly above the level of the yarn guide 24 so that the yarn Y follows a slightly V-shaped path of travel. The position of the yarn guides 24, 26 and 27 causes the yarn Y to be somewhat deflected and to follow a path of travel through the tension indicator which includes no sharp or drastic changes of direction so that no excess tension is applied to the yarn as it passes through the tension indicator. The tension in the running yarn tends to pivot the pointer lever 21 in a clockwise or upward direction in FIG. 2 and the running yarn follows a path generally parallel with the normal position of the pivot lever 21.

A counterweight, in the form of a second collar 30, is supported for longitudinal adjustment along the second arm of the pointer lever 21. Indicia, in the form of a suitable scale 35, is provided on the base plate 20 and adjacent the pointed free end of the first arm of the pointer lever 21. The scale 35 may include numerals or may include sections of different colors, as illustrated. The scale 35 is provided so that a constant visual indication of the tension in the running yarn is provided for the operator of the machine.

In order to properly set the yarn tension indicator 10, the knitting machine is operated with the elastomeric yarn Y being fed to the needles 15 and through the yarn feed finger 14. The tension in the yarn is checked by the use of the portable tensiometer positioned in engagement with the yarn Y and the tension device 12 is adjusted by the adjustment knob 13 until the desired amount of tension is obtained in the running yarn Y. When the proper number of grams of tension is being applied to the running yarn Y, the operator adjusts the position of the weight (collar 25) along the pointer lever 21 until the pointed end is positioned near the middle position of the scale 35. The counterweight (collar 30) is then adjusted along the pointer lever 21 until the pointed end of the pointer lever 21 is in the exact center of the scale 35, as indicated in FIGS. 1 and 2.

As long as the tension in the running elastomeric yarn Y remains at the level it was at the time the pointer lever 21 was set by the operator, the pointer lever 21 will remain in the horizontal position indicated in the drawings, and the operator is provided with a constant visual indication of the amount of tension in the running yarn Y. If the amount of tension in the yarn Y decreases, the weight (collar 25) moves the pointer lever 21 in a counterclockwise or downward direction, against the force of the yarn Y tending to move the pointer lever 21 in the clockwise or upward direction. The pointed end of the pointer lever 21 will thus be moved downward from the medial position and to a lower position on the scale 35.

When the operator passes the knitting machine and notes that the pointer lever 21 is positioned below the medial point of the scale 35, the operator will immediately know that the tension in the yarn Y has decreased and the operator can then rotate the adjustment knob 13 of the tension device 12 to increase the tension so that the pointer lever 21 is again positioned in the medial position of the scale 35. Thus, the tension in the yarn can be corrected without the necessity of again checking the tension in the running yarn with the portable tensiometer. Also, if the tension in the running yarn Y increases, the pointer lever 21 will be moved in a clockwise or upward direction from that illustrated in FIG. 2 and the operator will immediately know that the tension in the yarn has increased and can then adjust the knob 13 to decrease the tension applied to the yarn Y by the tension device 12.

Signal means is carried by the base plate 20 and is operable by the pointer lever 21 when the pointer lever moves below the lower limit of the scale 35, when a yarn is broken, or when the yarn is under very low tension. The signal means includes a stop post or pin 40 which is fixed at its inner end in the base plate 20 and is electrically insulated from the base plate 20. The pin 40 has a wire 42 connected at one end thereto and the wire 42 forms a portion of an electrical circuit which may be connected to the conventional stop mechanism of the knitting machine or to a signal light or the like.

If the yarn Y should break, the weight (collar 25) will immediately move the pointer lever 21 in a counterclockwise direction so that the pointer lever 21 will engage the pin 40 and complete a circuit to the signal device which may operate to immediately stop the knitting machine and/or turn on a signal light to indicate to the operator that the yarn has broken. The machine will also be stopped in the same manner when the yarn is running with an unusually low tension so that the weight moves the pointer lever 21 in a counterclockwise direction a sufficient amount that the lower portion of the pointer lever 21 will engage the pin 40.

The yarn tension indicator of the present invention thus provides for continuously monitoring the tension of the yarn Y as it is withdrawn from the yarn supply 11 and fed through the yarn feed finger 14 to the needles 15 of the knitting machine. The yarn tension indicator 10 is of simple construction and virtually trouble free in operation. The changes of direction which take place in the yarn passing through the tension indicator are very slight so that very little additional tension is placed on the yarn by the tension indicator. The yarn tension indicator 10 is operable for providing a constant visual indication of the tension in various types of running yarns requiring varying amounts of tension while being fed to various types of knitting machines.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a circular hosiery knitting machine particularly adapted for incorporating elastomeric yarn into knitted articles being formed thereby and including an elastomeric yarn supply source, a circle of needles, yarn feed finger means for feeding the elastomeric yarn from said supply source to said circle of needles, a manually adjustable tension device positioned between said supply source and said yarn feed finger means and adapted to engage and apply a predetermined amount of tension to the elastomeric yarn, a yarn tension indicator between said tension device and said feed finger means for continuously monitoring the tension of the elastomeric yarn and visually indicating to a machine operator the relative amount of tension in the yarn, and said tension indicator comprising a base plate, the combination therewith of a pointer lever pivotally supported on said base plate in a substantially horizontal position and being movable in first and second opposed directions above and below said horizontal position, movable yarn guide means supported on said pointer lever for longitudinal adjustment along substantially the full length of said pointer lever, fixed yarn guide means on said base plate for guiding the yarn in a substantially horizontal path of travel and passing through said movable yarn guide means on said pointer lever so that the tension in the running elastomeric yarn tends to move said pointer lever in said first direction, weight means supported for longitudinal adjustment along said pointer lever for urging said pointer lever in said second direction, and indicia means carried by said base plate adjacent said pointer lever for providing a constant visual indication to the machine operator of the relative amount of tension in the running elastomeric yarn.

2. In a circular hosiery knitting machine according to claim 1 wherein said weight means includes a collar supported for longitudinal adjustment along said pointer lever, and wherein said movable yarn guide means include a yarn guide fixed on said collar and through which the elastomeric yarn is guided so that the tension in the running elastomeric yarn tends to pivot said pointer lever in said first direction.

3. In a circular hosiery knitting machine according to claim 2 wherein said pointer lever comprises first and second pointer arms including outer free ends and inner ends supported for pivotal movement on said base plate, wherein said movable yarn guide and said collar are supported on said first arm of said pointer lever and between said outer free end and the pivot and including a second collar supported for longitudinal adjustment on said second arm of said pointer lever and providing a counterweight between the said outer free end and the pivot.

4. In a circular hosiery knitting machine according to claim 1 including sensor means carried by said base plate and being operable by said pointer lever when said pointer lever is moved below a predetermined limit for signalling a broken yarn, or a yarn with an unusually low tension.

5. In a circular hosiery knitting machine according to claim 3 wherein said indicia means comprises a scale carried by said base plate and positioned beneath said outer free end of said first arm of said pointer lever.

6. In a circular hosiery knitting machine according to claim 3 wherein said pointer lever includes a pivot collar with said inner ends of said first and second arms of said pointer lever being fixed to opposite sides of said pivot collar and extending outwardly therefrom in opposite directions, and including a pivot stud fixed in said base plate and pivotally supporting said pivot collar thereon.

7. In a circular hosiery knitting machine according to claim 4, wherein said sensor means carried by said base plate includes a stop post positioned in spaced apart relationship and below said pointer lever, said stop post being adapted to be engaged by said pointer lever when said pointer lever is moved below a predetermined limit, and an electric wire connected to said stop post and forming part of an electrical circuit to signal when said stop post is engaged by said pointer lever.

* * * * *